US005387027A

United States Patent [19]

Maloney

[11] Patent Number: 5,387,027

[45] Date of Patent: Feb. 7, 1995

[54] TAKE APART FURNITURE

[75] Inventor: Timothy J. Maloney, Strasburg, Va.

[73] Assignee: One Design Inc., Winchester, Va.

[21] Appl. No.: 41,170

[22] Filed: Apr. 1, 1993

[51] Int. Cl.[6] ..... A47C 7/00

[52] U.S. Cl. ..... 297/440.13; 297/440.23

[58] Field of Search ..... 297/440.13, 440.14, 297/440.15, 440.16, 440.18, 440.19, 440.20, 440.21, 440.22, 440.23

[56] References Cited

U.S. PATENT DOCUMENTS

| | | | |
|---|---|---|---|
| 521,395 | 1/1894 | Van Norman . | |
| 1,419,647 | 6/1922 | Sheperdson . | |
| 1,508,697 | 9/1924 | Junker . | |
| 1,747,900 | 2/1930 | Jenny | 297/440.13 |
| 2,486,987 | 11/1949 | Scarett . | |
| 2,518,955 | 8/1950 | Stelzer . | |
| 2,532,863 | 12/1950 | Taylor . | |
| 2,534,413 | 12/1950 | Cenis . | |
| 2,720,253 | 10/1955 | Turner . | |
| 2,979,864 | 4/1942 | Eide . | |
| 3,537,497 | 9/1970 | Self . | |
| 3,547,491 | 5/1968 | Bovasso . | |
| 4,140,065 | 2/1979 | Chacon | 297/440.13 |
| 4,509,794 | 4/1985 | Roland . | |
| 4,533,174 | 9/1985 | Fleishman . | |
| 5,000,514 | 3/1991 | Hanson | 297/440.23 |

*Primary Examiner*—Laurie K. Cranmer
*Attorney, Agent, or Firm*—Finnegan Henderson Farabow

[57] ABSTRACT

A furniture structure for chairs, benches and the like consisting of substantially planar members which interlock and reversibly unlock without the use of tools or separate fasteners, comprises two sides, a seat member, a back and a front, the sides each having an upper edge, and the seat member including a forward edge and a rear edge. An interlocking sector on each of the sides interlocks with the seat member, the back and the front without the need for tools or separate fasteners. The interlocking sector includes first and second members on each of the sides for frictionally engaging the forward and rear edges of the seat member, respectively, in opposite directions. A third member on each of the sides frictionally engages the seat member in a direction substantially perpendicular to the opposite directions. Back locks on each of the sides interconnect the back to each of the sides, and include an upper back lock and a lower back lock, The lower back lock is separated from the upper back lock at least by a distance equal to the distance between the upper edges of the sides when the structure is in a fully assembled condition. A front lock on each of the sides interlocks the front to each of the sides.

13 Claims, 2 Drawing Sheets

TAKE APART FURNITURE

BACKGROUND OF THE INVENTION

1. Field of the Invention

This invention relates to furniture made of planar elements which interlock and reversibly unlock without the use of tools, hardware, wedges, pegs or the like. The severely flat surfaces of such furniture result in equally severe limitations on the types of furniture which can benefit from the storage and shipping savings inherent in such furniture. Furniture made under the prior art is typically seen as non utilitarian toy furniture or for utilitarian use only by small children. While conventional full-sized furniture construction uses glue and/or small fasteners installed with tools, planar-tooless construction in forgoing these aids results in rather large unusual looking joints with the result of a second barrier to wider acceptance by markets. A third barrier results from the lack of conventional structural rigidity, particularly in the legs which the flat planar construction yields when plywood or the like is used in furniture scaled to adult proportions. This invention resolves to a greater degree these limitations by affording more conventional structure and appearance and in the case of furniture to be used outdoors by including long term tolerance to weather in order to benefit from the greater design latitude which consumers tolerate to receive the benefits of weatherability.

2. Description of the Related Art

Take apart furniture made of planar components has been disclosed in the prior art. For example U.S. Pat. No. 1,419,647 describes toy furniture which if scaled up to adult size, would be likely to have significant side sway. U.S. Pat. No. 2,518,955 reveals a chair, in which the rear of the seat is not restrained from flipping up and becoming "unlocked" if an adult were to sit near the front edge of the seat. U.S. Pat. No. 3,527,497 reveals a juvenile chair which assembled in part by using pegs and clips. U.S. Pat. No. 2,532,868 offers stiffness by resorting to the use of metal hardware. U.S. Pat. No. 2,720,253 adds additional planar components to facilitate construction. U.S. Pat. No. 4,533,174 discloses a single component, flexible chair of unconventional appearance. U.S. Pat. Nos. 521,395 and 2,486,987 disclose chairs having backs which are not precluded from separation if lifted. All of these patents disclose various elements, but none describes five-part, tooless, traditional looking, rigid-legged, full-sized furniture for use indoor and/or outdoors.

Accordingly, it is an object of the present invention to provide a take apart seating of the most conventional appearance composed of substantially a minimal number of planar parts and requiring the use of no tools or hardware during assembly.

It is a further object of the present invention to provide take apart seating with minimum amount of side sway particularly when sized for adults.

It is an additional object of the present invention to minimize the number and size of connection tabs and related fastening geometry in a ready-to-assemble furniture piece to facilitate a more conventional appearance.

A further object of the invention is to achieve more acceptable plywood edge quality to enhance both market acceptance and weatherability of a take apart furniture piece.

Additional objects and advantages of the invention will be apparent from the description which follows, or may be learned by practice of the invention.

SUMMARY OF THE INVENTION

To achieve the foregoing objects and advantages, and in accordance with the purposes of the invention as embodied and broadly described herein, the furniture structure of the present invention comprises at least two vertical sides which serve to rigidly interconnect with the remaining at least three parts and may carry a significant portion of the stylistic and related aesthetics of a given chair. In the case of an elongated chair in the form of a bench, it may be prudent to provide at least a third vertical support member between the said at least two vertical members. To effectively pursue the "look" and style of a given antique style or a given type of chair or table it may be prudent to incorporate more then the minimum said at least three remaining parts. The back attaches at or near the upper extremity of each of the outermost sides and at at least one other point lower. It is preferred that the said lower point is as far below the horizontal seat member as a given "look" or style of furniture aesthetically permits in order to achieve the longest structural triangle, the three points of which triangle consists of the two upper extremities of the two sides at the point of connection with the back and the lowermost point of connection of the back with either of the two sides. The same principal applies to the said front which similarly seeks to have the lowest aesthetically acceptable point of locking contact with the sides.

The horizontal member serving as a seat locks to the sides at a minimum of three points of frictional contact with each of the said sides and may have a fourth point of frictional contact near the front. The first two points of frictional contact per said side occur where forward and rearward portions of the horizontal member bears frictionally against vertical or nearly vertical surfaces in each of the said sides. Enhanced lateral stability of the furniture structure results over long use when the said nearly vertical surfaces are slightly inclined apart upwardly. A horizontal member which fits tightly between two nearly vertical surfaces in a new chair slowly wears it's way down the nearly vertical surfaces and continues to remain tighter than would be the case if the said nearly vertical surfaces were truly vertical.

It is preferred that the said two vertical sides of the furniture structure slope toward one another from bottom to top for the purpose of creating a trapezoidal relationship in the vertical plane between the horizontal member, the two sides and the ground rather than the less structurally stable rectangle that would result if the sides were parallel. A similarly desirable but horizontal trapezoid shape results in the preferred embodiment when the sides are further apart at the front that at the rear. Members must be easily related to their interlocking parts with only the force of the unassisted human hand without the mechanical advantage of a tool. Joints left loose enough for this tooless assembly remain loose, unstable and lack lateral stiffness. It is therefore part of this invention to interlock sides, back and front to one another which have ample clearance for easy manual assembly when at ninety degrees to each other and only then to rotate horizontally sides, back and front to an angle ninety degrees thereby closing the gaps between interlocking members and frictionally inducing significantly enhanced rigidity.

BRIEF DESCRIPTION OF THE DRAWINGS

The accompanying drawings which are incorporated in and constitute a part of the specification illustrate the present preferred embodiments of the invention and, together with the description serve to explain the principles of the invention.

DESCRIPTION OF THE PREFERRED EMBODIMENT

Reference will now be made in detail to the present preferred embodiments of the invention, as illustrated in the accompanying drawings. The present invention is a furniture structure suitable for configuration in numerous styles of indoor or outdoor weatherable chairs, benches or the like. In accordance with the invention, first is illustrated a chair configuration which comprises not less than five members which interlock without the use of tools or fasteners and which incorporates an aesthetically unobtrusive number and type of interconnect means, which furniture structure is preferably made from sheet material such as plastic or plywood or from cast material which in each case must have sufficient stiffness to yield an acceptably low level of side sway.

Figure 1:
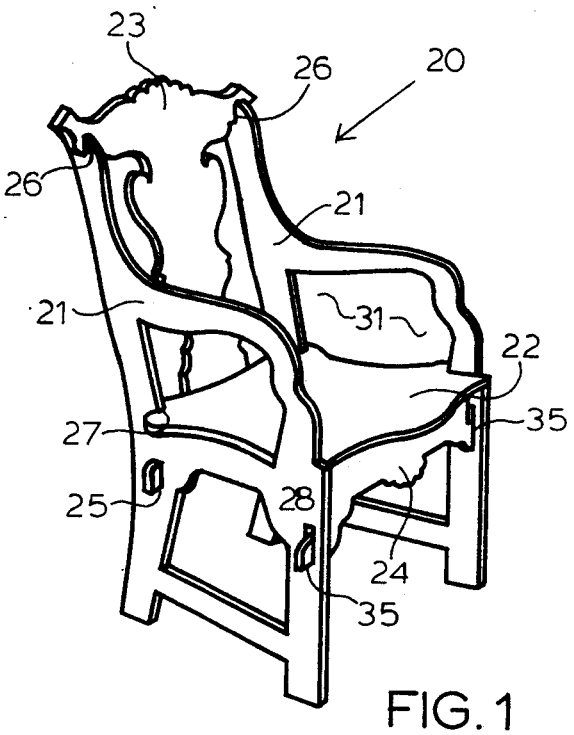
FIG. 1 is a perspective view of a chair configuration of the present invention.

FIG. 1 shows a furniture structure consisting of 5 parts generally designated by the numeral 20 consisting of two sides 21, a horizontal seat 22, a vertical back 23 and a vertical front 24, in which furniture structure the two sides 21 have the means 35, 25, 26, 27 and 28 for interlocking with the three other components, 22, 23 and 24.

Figure 2:
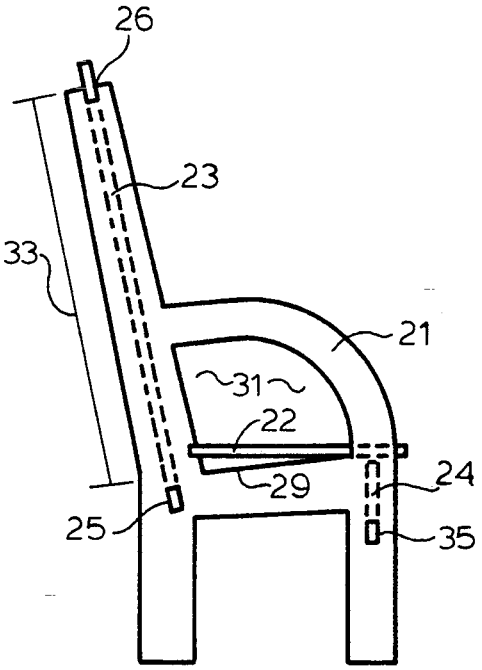
FIG. 2 is a vertical elevation of the side of a chair configuration of the invention.
Figure 3:
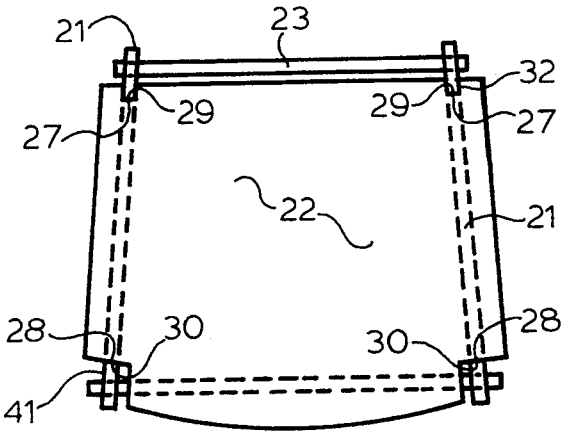
FIG. 3 is a plan view of the horizontal member shown in a chair configuration of the invention.

FIG. 3 is a plan view illustrating where the two sides 21 are shown impinging on the horizontal seat member 22 at three friction points, the first and the second of which frictionally impinge portions of the forward edge 28 and the rearward edge 27 of the horizontal seat 22 against opposing more or less vertical edges 29 and 30 of the vertical edged openings. The vertical edge openings 31 in the sides 21 are shown in FIG. 2. The rearward more or less vertical edge 29 slopes downward and forward so that a seat may maintain a tight fitting relationship to that sloped surface as the rear edge 27 of the seat wears its way down rear surface 29. FIG. 3 also illustrates the at least third friction point 32 which impinges the sides 21 frictionally on the horizontal seat member near the vertical back 23 in a direction perpendicular to the first and second frictional points. A fourth friction point similar to the third could be utilized near the front edge of the seat at 41.

Figure 4:
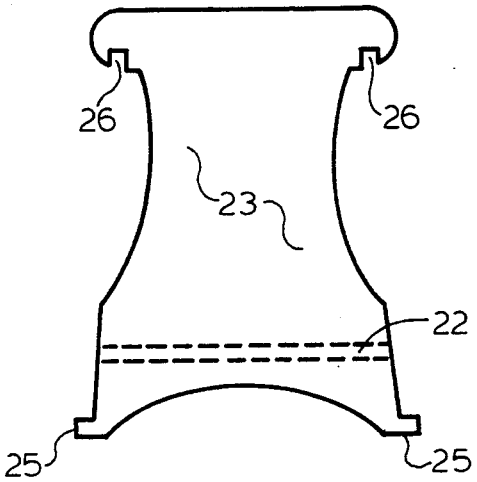
FIG. 4 is a vertical elevation of the back of a chair configuration of the present invention.
Figure 5:
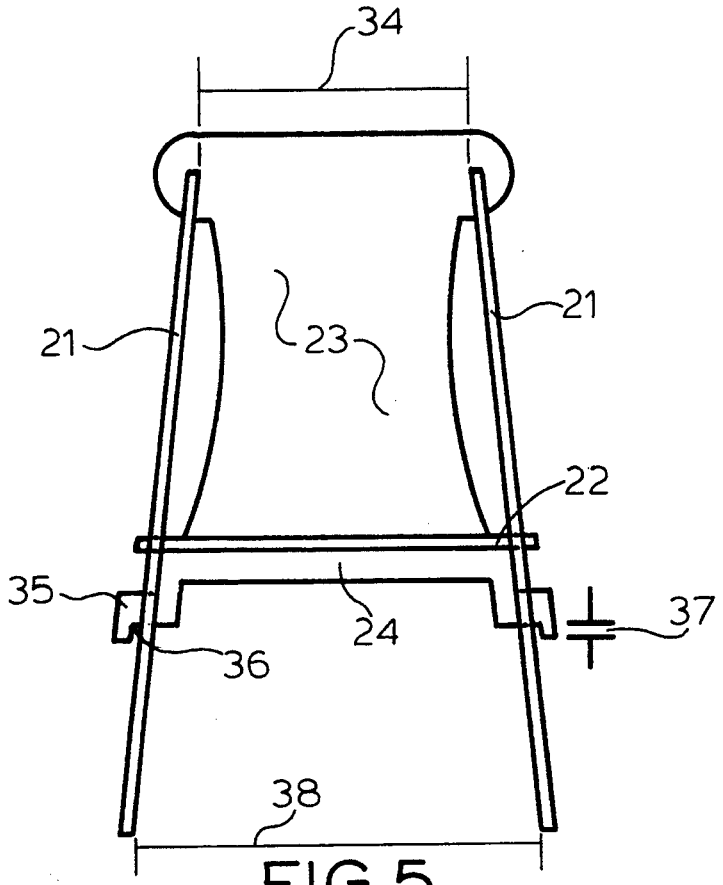
FIG. 5 is a front elevation of a chair configuration of the present invention showing the front below the horizontal seat member and the back with it's lower portion hidden from view.

FIGS. 2 and 4 illustrate the back 23 with means for interlocking with each of the two sides 21 in at least two places. The highest of which 26 occurs near the uppermost point of the sides and the second of these places 25 is located lower then the uppermost point 26 by a generally vertical distance 33 which is at least equal to a second generally horizontal distance between the uppermost edges of the two sides shown in FIG. 5 at numeral 34. FIG. 5 also illustrates a front 24 deployed below the horizontal seat member 22 with means 35 for rigidly interlocking the said front with the two sides 21 via positive contact means 36 by traveling downward a distance 37 equal at least to one third the thickness of the horizontal seat. There may be instances in which for design or other reasons it is desirable to leave off positive contact means 36 and the related downward travel locking 37. This rigid interlocking can result from a number of different means, but for simplicity when chairs are manufactured from sheet goods using a computerized numerical controlled cutter (CNC), laser or water jet method of cutting, blind cuts, that is cuts which do not extend all the way through the sheet goods are avoided when possible. This is because they result in left and right differentiated sides which increase quality control concerns and inventory complexity.

Figure 6:
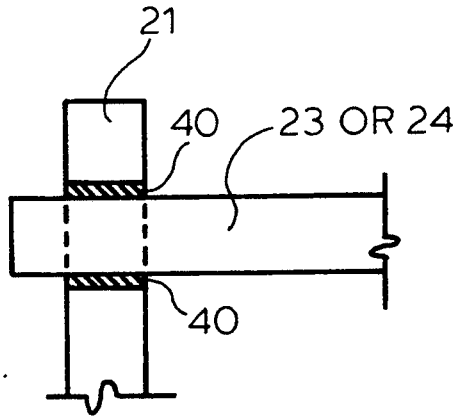
FIG. 6 is a schematic cross sectional cut away through one embodiment of the fastening means between one of the two vertical sides and the front or the back prior to rotation to a final frictional locking position.
Figure 7:
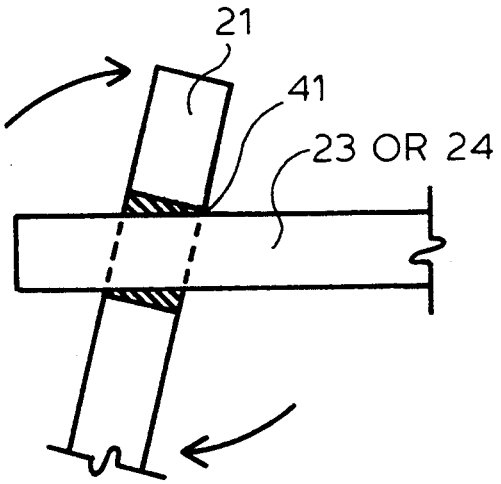
FIG. 7 is a view similar to FIG. 6 showing the same fastening means after rotation to final frictional locking position in the present invention.

FIG. 6 illustrates a first mating of a side 21 at either end of either a front 24 or a back 23 with the desired liberal clearance 40 to permit easy manual assembly of the parts. FIG. 7 illustrates the same joint as FIG. 6 after rotation achieves a second firmer mating in which said liberal clearance 40 is replaced by tight frictional final locking 41 of parts. This frictional fit benefits from the mechanical advantage available to the assembling person which utilizes the parts being assembled as lever tools. In some cases it may be desirable to utilize only the first non rotated fit without benefit of the second rotated fit.

The preferred furniture structure may be suitable for both indoor or outdoor use. Plywood suitable for use out of doors typically utilizes water resistant phenolic resin between the veneers and, in the case of "medium density overlay plywood" the faces of the board are covered with resin impregnated craft paper, which greatly increases the number of years furniture can endure outdoor application, but also produces a corrosive environment when exposed to the high temperatures reached by metal cutting tools used during high speed cutting of the furniture parts. To avoid the resulting premature dulling of the cutting tool and the poor plywood edge quality which results, specialized non reactive Ferricide or other nonmetallic or hybrid or laser beam cutting offer meaningful improvements.

FIG. 5 also illustrates the preferred non-parallel relationship of the sides so that distance 34 between the upper end of the sides 21 is less than the distance 38 between the lower ends of the sides with the result of increased general stability of the chair by transmitting the more or less central loading of the horizontal seat downward and outward. This increases lateral stability and also reduces outward flexing of the leg portion of the said two sides. Outward flexing represents roughly half of total lateral flexing which occurs in planar leg chairs. FIG. 3 illustrates the non-parallel relationship between the sides 21 in the horizontal plane in the preferred embodiment of the invention. The advantage of this relationship is greater ability to configure chairs in a less rectilinear proportion to better emulate traditional non planar styles of the eighteenth and nineteenth century antique styles and thus to mitigate the "boxy" look negatively associated with planar furniture structures.

Additional advantages and modifications will readily occur to those skilled in the art. The invention in its broader aspects is therefore not limited to the specific details, representative apparatus and illustrative examples shown and described. Accordingly departures may be made from such details without departing from the spirit or scope of the general inventive concept defined by the appended claims and their equivalents.

What is claimed is:

1. A furniture structure for chairs, benches and the like consisting of substantially planar members which interlock and reversibly unlock without the use of tools or separate fasteners, comprising:

two sides, a seat member, a back and a front, the sides each having an upper edge, and the seat member including a forward edge and a rear edge; and means on each of the sides for interlocking with the seat member, the back and the front without the need for tools or separate fasteners, the interlocking means including:

first and second means on each of the sides for frictionally engaging the forward and rear edges of the seat member, respectively, in opposite directions;

third means on each of the sides for frictionally engaging the seat member in a direction substantially perpendicular to the opposite directions;

back lock means on each of the sides for interconnecting the back to each of the sides, including upper back means and lower back means, the lower back means being separated from the upper back means at least by a distance equal to the distance between the upper edges of the sides when the structure is in a fully assembled condition; and front lock means on each of the sides for interlocking the front to each of the sides.

2. The structure of claim 1, wherein the front lock means includes a slot on each side, and the front includes a corresponding lock for insertion into each of the slots, each lock having a contact surface thereon for frictionally contacting one of the sides when the front is interlocked to the sides.

3. The structure of claim 1, wherein the forward edge of the seat is wider than the rear edge between the sides.

4. The structure of claim 1, wherein the sides are locked into a substantially non-parallel relation to each other, the distance between the upper edges being less than the distance between the remainder of the sides.

5. The structure of claim 1, wherein the sides are locked into a substantially non-parallel relation to each other, the front having a width greater than the back, and the distance between the upper edges being less than the distance between the remainder of the sides.

6. The structure of claims 1, 4 or 5, wherein the sides, seat member, back and front each comprises a weatherable sheet material.

7. The structure of claim 6, wherein the sheet material comprises one of plywood, resin overlaid plywood, plastic and moldable material.

8. A furniture structure for chairs, benches and the like consisting of substantially planar members which interlock and reversibly unlock without the use of tools or separate fasteners, comprising:

two sides, a seat member, a back and a front, the sides each having an upper edge, the seat member including a forward edge and a rear edge, and the back and seat member being joined to each other; and means on each of the sides for interlocking with the seat member, the back and the front without the need for tools or separate fasteners, the interlocking means including:

first and second means on each of the sides for frictionally engaging the forward and rear edges of the seat member, respectively, in opposite directions;

third means on each of the sides for frictionally engaging the seat member in a direction substantially perpendicular to the opposite directions;

back lock means on each of the sides for interconnecting the back to each of the sides; and front lock means on each of the sides for interlocking the front to each of the sides.

9. A method for assembling a furniture structure for chairs, benches and the like consisting of substantially planar members which interlock and reversibly unlock without the use of tools or separate fasteners, the structure including two sides, a seat member, a back and a front, the sides each having an upper edge, and the seat member including a forward edge and a rear edge; and means on each of the sides for interlocking with the seat member, the back and the front without the need for tools or separate fasteners, the interlocking means including first and second means on each of the sides for frictionally engaging the forward and rear edges of the seat member, respectively, in opposite directions; third means on each of the sides for frictionally engaging the seat member in a direction substantially perpendicular to the opposite directions; back lock means on each of the sides for interconnecting the back to each of the sides, including upper back means and lower back means, the lower back means being separated from the upper back means at least by a distance equal to the distance between the upper edges of the sides when the structure is in a fully assembled condition; and front lock means on each of the sides for interlocking the front to each of the sides, comprising the steps of:

attaching the back to each of the sides using the upper back means and the lower back means;

loosely engaging the seat member between the two sides;

locking the front to the sides using the front lock means; and exerting pressure on the seat member to frictionally lock the structure together at the first, second and third means.

10. The method of claim 9, wherein the step of exerting pressure on the seat member includes forcibly rotating the sides, back and front to a substantially non-perpendicular relationship to tighten the structure.

11. The method of claim 9, wherein the step of loosely engaging the seat member includes initially maintaining a substantially perpendicular relation between the sides and the back, and the step of exerting pressure on the seat member includes moving the sides, back and front to a substantially non-perpendicular relation when the structure is locked together.

12. The method of claim 9 including a step of cutting the sides, back, seat member and front from a single sheet of material in symmetrical pairs to enhance manufacturing efficiency.

13. The method of claim 12 wherein the cutting includes using a nonmetallic, hybrid, ferricide or laser cutting tool to improve the texture of the edges of the cut material.

* * * * *